US008857641B1

(12) United States Patent
Moore, Jr. et al.

(10) Patent No.: US 8,857,641 B1
(45) Date of Patent: Oct. 14, 2014

(54) MANIPULATING AND RESTRAINING A TWO PIECE SEPTIC TANK

(75) Inventors: Roy E. Moore, Jr., Killingworth, CT (US); Paul R. Holbrook, Old Saybrook, CT (US); Bryan A. Coppes, Old Saybrook, CT (US); Nimish Gandhi, Wethersfield, CT (US)

(73) Assignee: Infiltrator Systems Inc, Old Saybrook, CT (US)

( * ) Notice: Subject to any disclaimer, the term of this patent is extended or adjusted under 35 U.S.C. 154(b) by 0 days.

(21) Appl. No.: 13/412,466

(22) Filed: Mar. 5, 2012

Related U.S. Application Data

(60) Provisional application No. 61/449,595, filed on Mar. 4, 2011.

(51) Int. Cl.
*B65D 88/76* (2006.01)
*B65D 8/00* (2006.01)

(52) U.S. Cl.
CPC ..... *B65D 11/02* (2013.01)
USPC ..... 220/4.24; 220/4.12; 220/759; 220/567.1

(58) Field of Classification Search
USPC ..... 220/4.12, 4.13, 4.21, 4.24, 4.26, 751, 220/752, 769, 772, 756, 754, 759, 770, 220/567; 210/532.2; D23/203; 206/504, 206/505, 506, 509, 510, 511, 512, 516, 519
See application file for complete search history.

(56) References Cited

U.S. PATENT DOCUMENTS

| | | | | | |
|---|---|---|---|---|---|
| 1,221,789 | A * | 4/1917 | Brown | 206/515 |
| 3,048,317 | A * | 8/1962 | Cochrane et al. | 229/103.1 |
| D207,294 | S * | 3/1967 | Ferm | D23/203 |
| 3,358,616 | A * | 12/1967 | Brodhead | 410/44 |
| 3,426,903 | A * | 2/1969 | Olecko | 210/232 |
| 4,359,167 | A * | 11/1982 | Fouss et al. | 220/675 |
| 5,361,930 | A * | 11/1994 | Perry | 220/565 |
| 5,487,604 | A * | 1/1996 | Moran | 366/225 |
| 5,716,163 | A * | 2/1998 | Nichols et al. | 405/43 |
| 6,227,396 | B1 * | 5/2001 | Small | 220/4.12 |
| 6,513,343 | B2 * | 2/2003 | Pahl | 62/457.3 |
| 6,698,975 | B1 * | 3/2004 | Benecke | 405/43 |
| 6,786,689 | B2 * | 9/2004 | Dorris | 410/47 |
| 6,962,265 | B1 * | 11/2005 | Zhang | 220/759 |
| 7,144,506 | B2 * | 12/2006 | Lombardi, II | 210/532.2 |
| 7,572,372 | B2 * | 8/2009 | Graf | 210/232 |
| 7,854,338 | B2 * | 12/2010 | Graf | 220/4.06 |
| 8,070,005 | B1 * | 12/2011 | Kruger et al. | 220/4.13 |
| 2005/0077301 | A1 * | 4/2005 | Bolzer et al. | 220/567.1 |
| 2009/0314791 | A1 * | 12/2009 | Hartley et al. | 220/751 |

* cited by examiner

*Primary Examiner* — Fenn Mathew
*Assistant Examiner* — Robert Stodola
(74) *Attorney, Agent, or Firm* — C. Nessler

(57) ABSTRACT

A molded plastic tank, optionally a septic tank, for containing liquid, comprises two injection molded plastic half tanks that have concave exterior walls and integral flanges, and that nest within each other for shipment or storage. Lengthwise ends of the half tanks have grips, for manual or machine lifting of the half tank from the top of a concave-down stack of half tanks, and for then assembling whole tanks. A sling is used to machine lift one or several half tanks by attachment to the grips or to lifting lugs at the top of the half tank. A corrugated septic tank having spaced apart access port regions has a grid of ribs in the exterior top valley corrugations and running across the access port region, to provide strength during testing and use.

10 Claims, 9 Drawing Sheets

MANIPULATING AND RESTRAINING A TWO PIECE SEPTIC TANK

TECHNICAL FIELD

The present invention relates to tanks for containing liquids, in particular to tanks which are assembled from molded plastic half tanks, especially septic tanks.

BACKGROUND

Large oblong plastic tanks, such as those for containing water, or for containing wastewater in the particular case of septic tanks, have been fabricated by various means in the past, including by molding two dish-shape halves and then mating the halves at a lengthwise planar joint. U.S. Pat. No. 5,361,930 of Perry, U.S. Pat. No. 7,572,372 to Graf and U.S. Pat. No. 5,878,907 to Graf describe such kinds of tanks. Such type of tank construction provides an advantage over one piece plastic tanks in that half tanks may be nested for shipment and storage, potentially reducing handling, storage and transport costs. And it can provide an economic and ease-of-handling advantage over heavy concrete septic tanks that are also typically comprised of concave halves which are mated at the point of use.

Commercial Graf patent type of tanks have been made by injection molding, which produces good dimensional control and fidelity. That means better engineering use of plastic material than is achieved in less dimensionally precise tanks, such as are made by fiberglass resin lay-up or by blow molding or rotational molding. In one approach, described in the Graft patents, each injection molded tank half is identical, which lowers the cost of tooling.

The present invention relates to improvements useful with oblong shape injection molded half tanks that are later assembled into whole tanks, particularly septic tanks, either at the point of use, or more preferably a satellite assembly point, from which they are thereafter transported to the site of use where they are installed in a pit created in soil.

In the past, one piece oblong plastic septic tanks often have had molded lifting lugs at the top of the tank, to enable transport and installation at the point of use. For example see the four tabs which are at the top of a rotationally molded tank, described in Kruger U.S. Pat. No. 8,070,005. Handling half tanks to make them into whole tanks can present somewhat different problems which are not solved by use of the prior art teaching. The reason is that half tanks are shipped and stored as nested stacks; and in a typical assembly process, one half is placed on a work surface with the concave side facing upwardly, while the other half has to be placed concave-down on top of it. Since assembly of a two-piece tank will likely take place at place away from the factory, and the parts can be large and heavy, there is a need for aids which facilitate the handling and assembly of the molded half tanks in a safe way and in a way which avoids damage to the joint region.

There is another aspect relating to use of a buried septic tank that is assembled from molded half tanks, which is shared with one-piece plastic tanks. It is that a tank must first resist the load of overlying soil load as well as possible loads from motor vehicles and the like; and for such purpose plastic tanks have had corrugated walls for such purpose. See for example descriptions of septic tanks in U.S. Pat. Nos. 7,178,686, 7,144,506, 4,359,167, 5,361,930, and U.S. Pat. Pub. No. 2002/0029026.

Typically two, and at least one, large access ports are needed at the top of the tank. Often a riser or lid is attached to the top of the tank at the port location. Access ports can reduce the load bearing capacity of the top of a tank. And when as in the aforementioned Graf tanks, and in the tanks of the present invention, the top and bottom halves are identical, planar surfaces of tank access port regions, when forming part of the bottom of the assembled tank, will tend to be weaker than the adjacent corrugated tank walls.

There are certain loads associated with handling and testing that are somewhat unique to half tank technology. For example, some times assembled tanks are tested in the assembly shop, as by filling with water or by applying a vacuum. And of course an assembled tank has to be handled by transporting it to point of use typically an excavation in the earth. A tank made from half tanks has to resist the stresses associated with such handling and testing, and sometimes it has to meet regulatory criteria by not changing in dimension more than a defined amount, when the tank interior is partially evacuated.

When the half tank forms the top of the buried whole tank, there is a load which results from hold-down tethers which typically run across the top of a septic tank from opposing side dead-weight anchors, to hinder the tank from rising from the soil if it is emptied when the surrounding water table is high. See U.S. Pat. Nos. 7,028,967 and 6,786,689 for examples of such anchors.

When a half tank forms the bottom of a tank, and the tank is set on a hard flat surface and filled with water for testing, the stress which result can be quite different from those encountered during normal use when the tank is buried in soft soil.

Generally, adding strengthening features to a tank top or elsewhere undesirably increases material and molding cost. When a tank is made from identical molded half tanks, that can mean that features added to increase the strength of the half used as the top, to provide for handling, can be an unnecessary and wasteful presence in the half that is used as the bottom, thus making more important good design. Thus there is a continuing need for economic tank design.

SUMMARY

An object of the invention is to provide means for handling half tanks, in particular for transporting same and for assembling whole tanks from half tanks by manual and mechanical assist means. Another object of the invention is to provide strength to a septic tank having access port regions during testing and during use. A further object is to achieve other objects in an economic way.

In accord with an embodiment of the invention, a molded plastic tank comprises two half tanks, each having a concave wall which terminates in a substantially planar flange running along the edge of the wall, for mating with the flange of a like half tank; and the half tank has a first means for lifting at each opposing end of the tank. In one embodiment, at each end there are spaced apart lifting means, such as flexible or rigid grips running between a pair of tabs, on either side of the vertical center plane of the half tank. Preferably the tabs are stacking tabs which keep the half tanks from jamming together when nested. Persons assembling whole tanks, may use the lifting means to remove, manually or with mechanical device assist, a half tank from a stack of concave-down nested like parts; then to rotate it in space and set it down on a work surface; next removing another half tank and placing it on top of the first piece, and fastening the flanges together.

In accord with an embodiment of the invention, four grip points, two at each end, are combined with a sling, so that one or several half tanks may be lifted from the top of a stack of nested concave-down half tanks. The sling may have means for receiving forks of fork lift trucks and the like.

In further accord with the invention, another embodiment half tank has four spaced apart lifting lugs, each near an access port at the top of the convex exterior of the tank. Each lug may comprise a plate drilled to receive a rope loop. A sling or chains may run from the lifting lugs to a lifting device such as a crane.

In accord with another aspect of the invention, a half tank which has two spaced apart circular regions shaped for providing access ports, has peak and valley corrugations running transverse to the length of the half tank. Each exterior surface valley has a grid of ribs, for strengthening the tank, particularly against the load of a hold-down tether connected to deadmen, when in use.

In another embodiment of the invention, the spaced apart circular regions of half tanks, which are suited for being cut to provide access ports, have exterior ribbing for stiffening and strengthening, which ribbing is sufficient in height to contact a planar surface upon which the half tank rests when setting concave up. Such ribbings enable the a half tank, which is oriented concave-up to form the bottom of a whole tank, to be supported on a flat hard surface, so that if the tank is filled with water, the weight of such does not unduly deflect and damage the bottom of the tank.

The foregoing and other objects, features and advantages of the present invention will become more apparent from the following description of preferred embodiments and accompanying drawings.

DESCRIPTION

While the invention is described in terms of a septic tank embodiment, it will be appreciated that the features of the invention can be applied to tanks suited for other uses. Typical characteristics and functional aspects of septic tanks are described in commonly owned patent application Ser. No. 12/445,774 of K. Kruger et al. (now U.S. Pat. No. 8,070,005) and Ser. No. 12/445,774 of R. Moore Jr. et al. (now U.S. Pat. No. 8,151,999) both filed Jun. 5, 2009, where a one-piece rotationally molded tank is described. The disclosures of the foregoing applications are hereby incorporated by reference.

Figure 1:
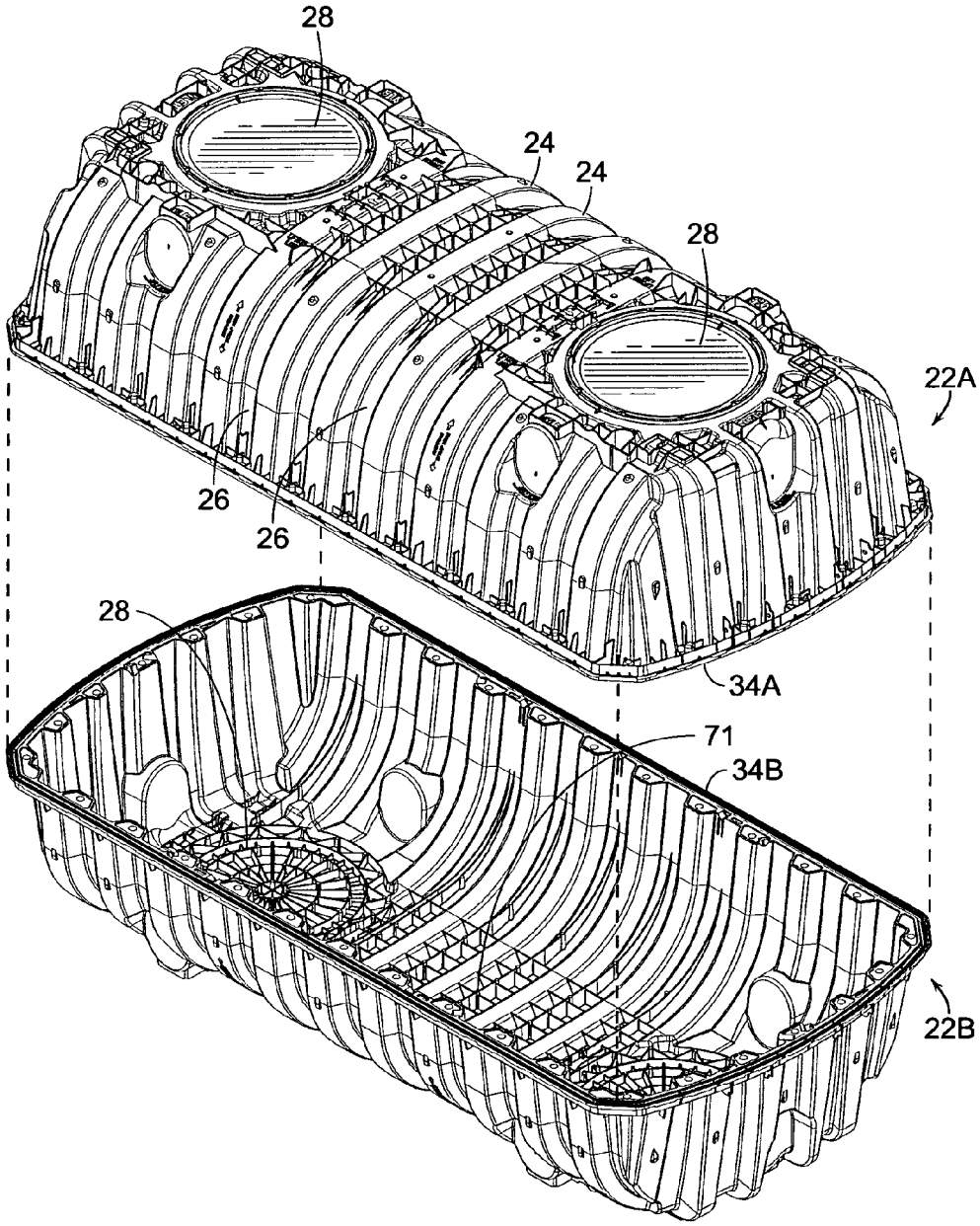
FIG. 1 is an exploded view showing how two molded concave half tank parts are mated at a horizontal flange joint to form a septic tank.
Figure 2:
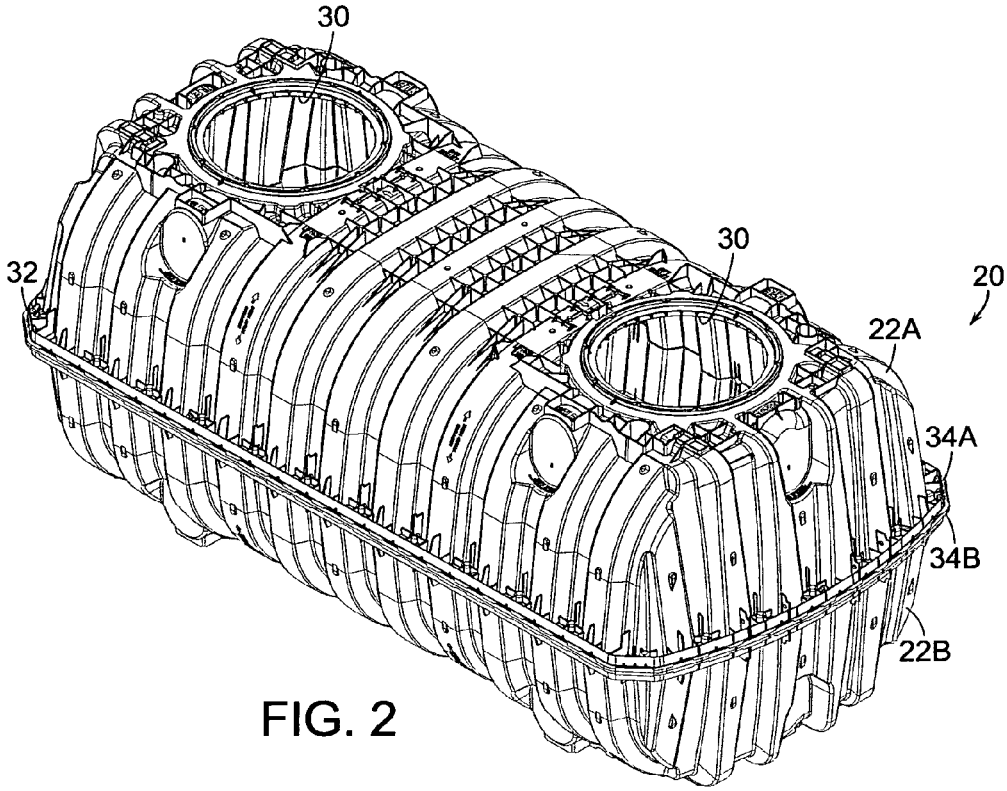
FIG. 2 shows a corrugated plastic septic tank which results from the assembly illustrated in FIG. 1, with the mated flanges are clamped to each other, and where ports have been cut in the circular plate regions at the top of the tank.

FIG. 1 and FIG. 2 illustrate how a septic tank 20 is fabricated by mating two identical injection molded plastic septic half tanks 22A, 22B at a horizontal center plane flanged joint 32. In the following description, an element identified by a number having a letter suffix generally corresponds with an element having the same number without suffix. And a number used without a suffix refers to a feature which is common to each of the two identical half tanks. Thus, by example, tanks in the present invention have a joint 32 formed at mating flanges 34; in particular, flange 34A is the flange of the upper half tank of an assembly and flange 34B is the flange of a lower half tank of an assembly.

Tank 20, and therefore each half tank 22 which comprises tank 20, has alternating peak corrugations 24 and valley corrugations 26. The tank wall does not vary greatly in thickness and therefore the corrugations are replicated on the interior. Each half tank 22 comprises a convex wall (when viewed from the tank exterior) which terminates in a substantially flat flange 34 which runs along and outwardly from the edge of the wall. The wall may be alternately characterized as having a concave interior. Each half tank 22 has a portion comprising a circular region 28 that is near each end, within which a hole may be cut to provide an interior access port 30 at the top of the tank. In use, access ports 30 are closed by hatch covers, not shown. Of course, ports/holes are not cut in the circular regions which form the bottom part of the tank. In the central part of the tank the corrugations run transverse to the length of the tank.

As shown, the flanges 34 where the half tanks mate are oblong, substantially planar surfaced, structures. The invention will be applicable to tank assemblies where a part of the tank is somewhat less or more than one-half of a tank in volume, and thus the term half tank should be construed in such context. Tank assemblies also may comprise mating flanges has other-than entirely planar shape, but they will be considered substantially planar for purposes of this description.

Figure 17:
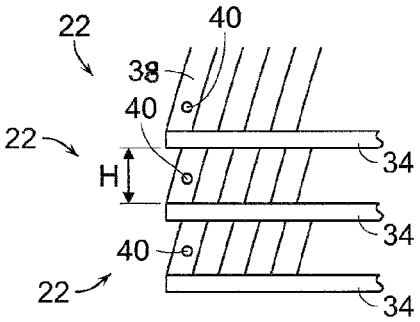
FIG. 17 is a fragmentary end view of a stack of concave-down facing half tanks.

When the half tanks are shipped from the factory, they are nested as a stack, typically in the concave-down position, as shown in the FIG. 17 fragmentary view, discussed further below. At the site of assembly, a tank assembler will typically remove a first half tank from the stack, rotate the half tank in space and set it down with the concave side facing upwardly. The person acting as worker/assembler will then lift another half tank from the stack, and place it concave-down on top of the first half tank, so the flanges 34 mate. In this operation, the assembler may be aided by a plurality of dowels which project upwardly from pockets in the concave-up part and which are received in pockets in the concave down top part, to align the parts. Typically a gasket or resilient seal is seated within mating grooves of the flanges. Details of the flange joint the joint and how the half tanks are clamped together is described in commonly owned patent application of P. Holbrook et al., entitled "Plastic Tank Having a Clamped Joint," and bearing Ser. No. 13,412,406, filed Mar. 5, 2012. The disclosure thereof is hereby incorporated by reference.

Figure 3:
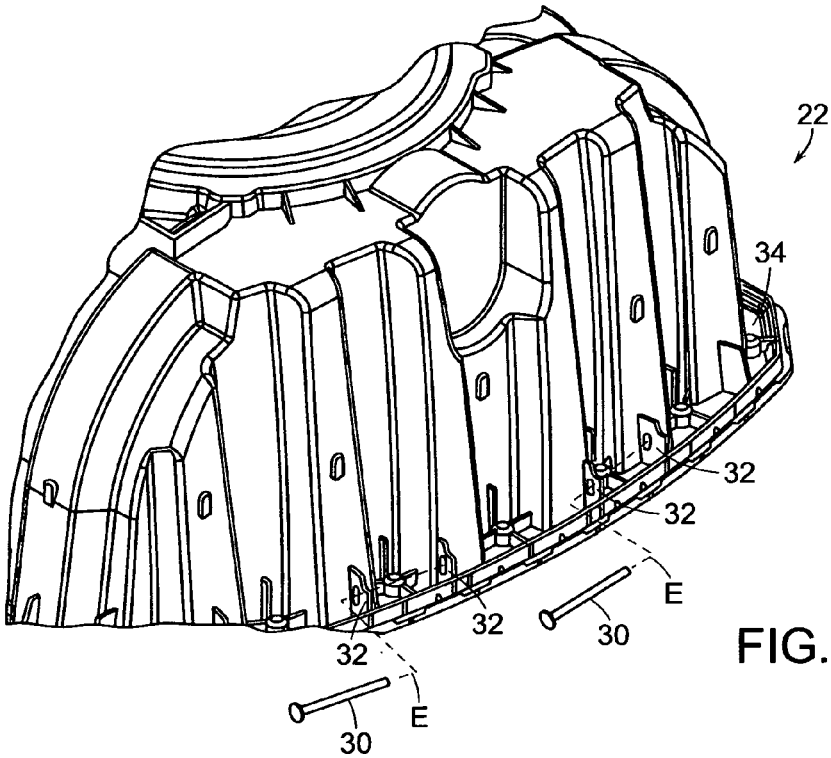
FIG. 3 shows in quasi-isometric view a portion of the end of a half tank having two lifting grips comprised of bars.

The present invention helps workers assemble tanks, particularly when fancy part handling devices are not available at the point of assembly. In embodiments of the invention, each opposing end of a half tank has one or more means for lifting. As an example, FIG. 3 shows a portion of the end of one half tank 22 and lifting means which comprises two spaced apart grips 30 on either side of the vertical center CP. In the FIG. 3 embodiment, the grips 30 comprise simple bars or pins, made of metal or plastic. Such grips are considered to be rigid members in terms of the present invention. The grips in this and other embodiments which follow may be removable or permanent.

As indicated by arrows E, grip bars 30 slip through holes in spaced apart pairs of tabs 32 which project from the end wall of the half tank. Thus, two assemblers, one at each end of the half tank, can grasp the grips and thereby lift a half tank upwardly from the top of a stack of concave-down halves; and, with suitable dexterity they can rotate the half tank in space so it is concave-up, then setting it down on the floor or other work surface. They then can then lift a second half tank from the stack using the grips of that second half, to place that second half 22A, concave-down, on the previously placed concave-up half. They will thus have formed the essential tank 20 shown in FIG. 2. In this and other embodiments, when the grips are configured for manual grasping, there will be a suitable spacing between a pair of tabs 32, namely about 5 inches or more; and the grips will preferably be spaced apart a distance approximating that between a worker's normally extended hands.

Preferably, the spacing between flanges of each nested tank in a stack, as determined by stacking lugs mentioned below, is sufficient to leave the grips 40 accessible for manual grasping. This will enable a worker using the grips to lift from the top of a stack one half tank; and by grabbing a half tank which underlies other half tanks it will enable the lifting of several nested half tanks, preferably with mechanical assist, as described below.

Figure 4:
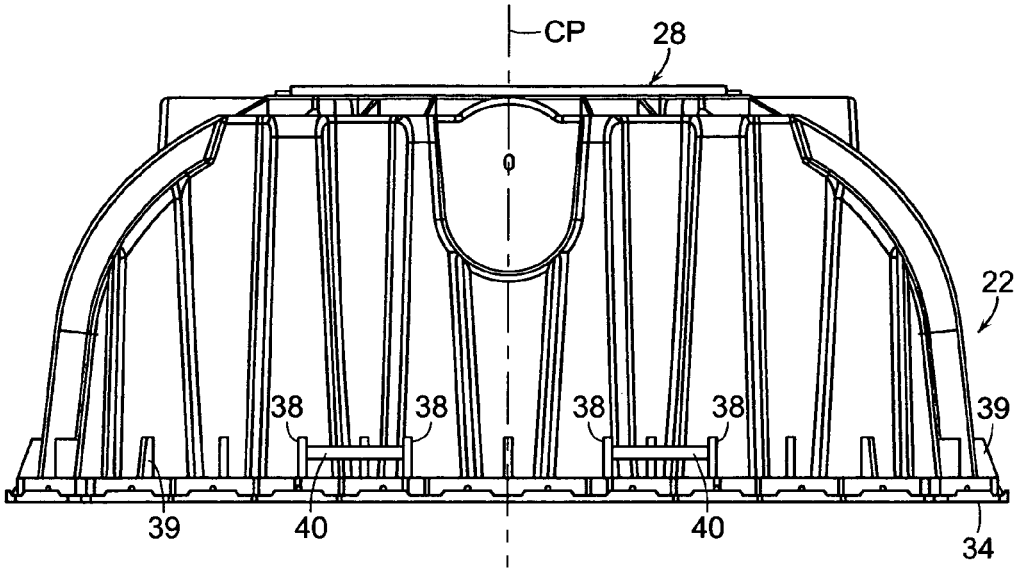
FIG. 4 is an end view of the end of a half tank having two lifting grips comprised of straps.
Figure 5:
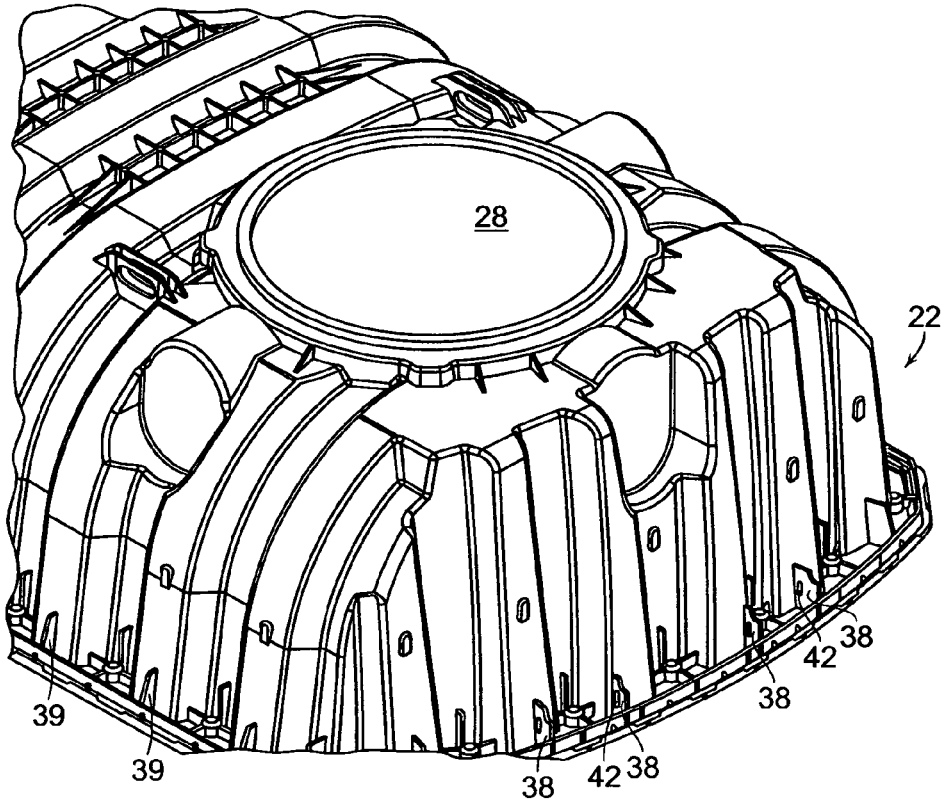
FIG. 5 is a quasi-isometric view of part of the end of a half tank showing tabs which are stacking lugs, to which strap grips are attachable at slot openings.

FIG. 4-7 illustrate another embodiment of the tank-lifting invention. The half tank end view of FIG. 4 shows two grips 40, which are flexible straps that run between slots 42 in spaced part tabs 38. The tabs 38 can be seen in more detail in the quasi-isometric half tank view of FIG. 5, and also of FIG. 6. The tabs may be in part or entirety dedicated features for use with grips. Alternately, they may also function as ribs for strength, and/or as stacking lugs which keep nested tanks from jamming into each other.

FIG. 4 shows how tabs 38 may serve multiple functions: For example tabs 38 function for use in connection with grips, both stacking lugs, and as ribs which impart strength to the flange and adjacent wall of the tank. A half tank may have numerous other stacking lugs 39, spaced apart along the flange, as can be seen in half tank 22A shown in FIG. 10.

Figure 6:
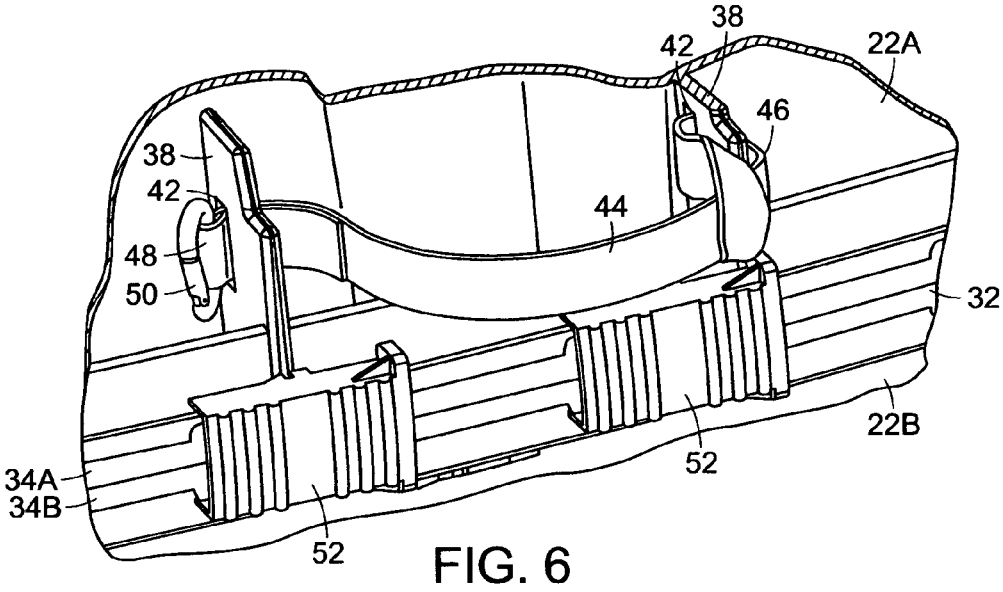
FIG. 6 is a close up view of a half tank in vicinity of a grip comprising a strap running between slots of stacking lug tabs which are illustrated in FIG. 5.
Figure 7:
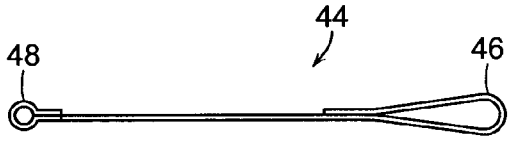
FIG. 7 is an edge-on view of one a strap which is shown in-place in FIG. 6.

FIG. 7 shows in edge view a flat strap 44 which may be run between the slots of adjacent tabs 38 to form the grip shown in FIG. 6. With reference to FIG. 6, to install the strap 44, the small loop end 48 is passed through the slot 42 of a first tab 38 (on the right); end 48 is then passed through the opening of the large loop end 46 and then run across the space between the tabs and through the slot 42 of the second tab 38. A clip 50 may then be passed through the opening of the small loop 48, to keep it from pulling back through the slot 42 of the second (left side) tab. FIG. 6 also shows two of a multiplicity of clips 52 which hold together the flanges 34 at joint 32, as described in the related Holbrook et al. patent application, referred to above.

Other flexible grip members may be used in substitution of straps 44 which are pictured as woven plastic strap in FIG. 6, including such as a knotted rope, a chain, and so forth. While the tabs for grips are preferably integrally molded as part of the tank, as pictured, in the generality of the invention tabs may be separate elements which are fastened to, or which latch into, the wall of the tank. While a flexible or rigid grip member may be only applied to the half tank at time it is lifted, and then removed, a grip member may be permanently attached to the end of the half tank.

Figure 12:
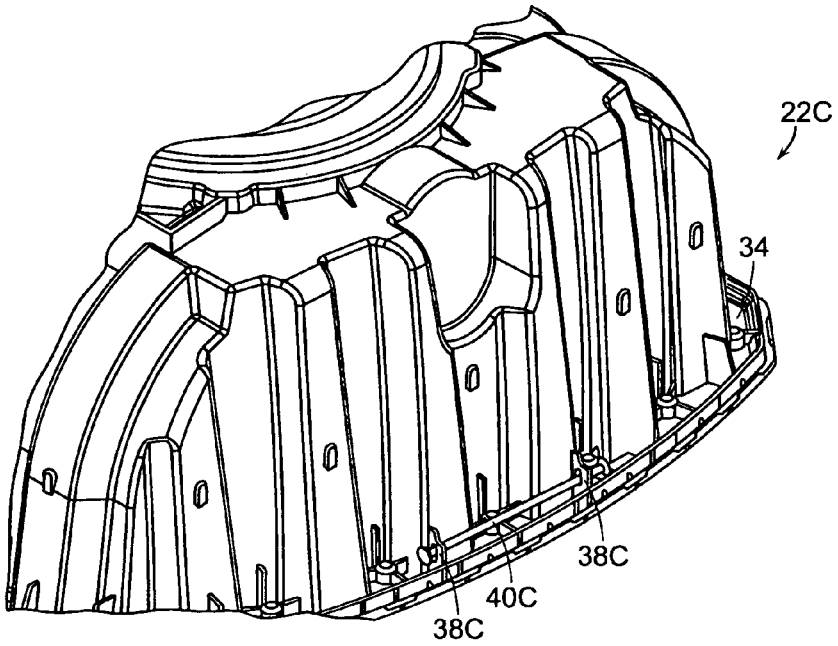
FIG. 12 is a view like that of FIG. 3, where a single lifting bar runs across the end of the tank.

FIG. 12 shows an alternate embodiment of the invention wherein a single bar 40C runs between two tabs 38C, one of which is on each side of the vertical lengthwise center plane the half tank 22C. A strap or other member may be substituted for the bar 40C. Preferably, the length of the bar or strap, as applies, more or less corresponds with the space between an average person's arms.

Figure 18:
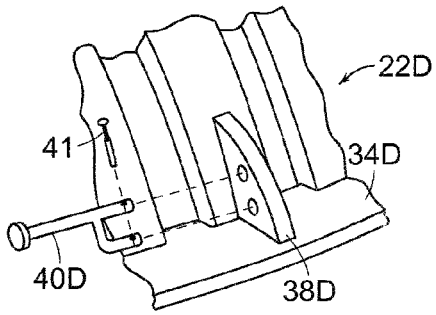
FIG. 18 is a fragmentary perspective view of the end of a half tank showing an alternative lifting means comprising a tab.

FIG. 18 shows in fragment another embodiment of the invention wherein the two prong-ends of rigid grip 40D slides into horizontal holes in single tab 38D of half tank 22D, which runs up from flange 38D. The grip is secured in place by pin 41; and the knobbed end of the grip can be grasped to lift the end of the half tank. Preferably, there is a like tab and grip on each side of the vertical center plane, as in other embodiments described above.

Figure 8:
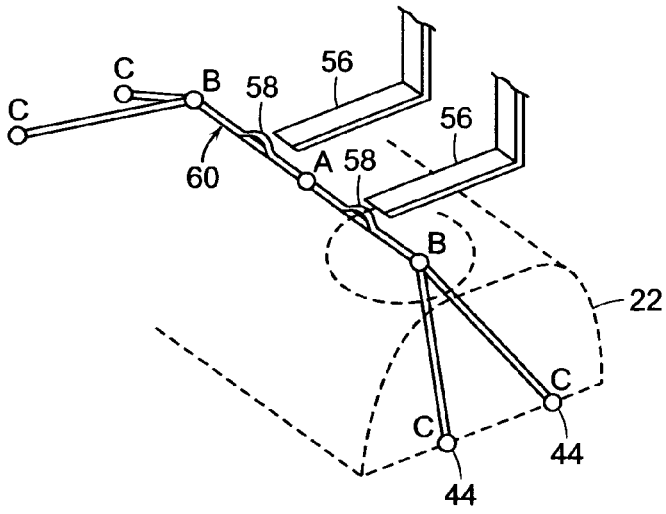
FIG. 8 shows a sling which is useful for lifting a half tank, shown in phantom.
Figure 9:
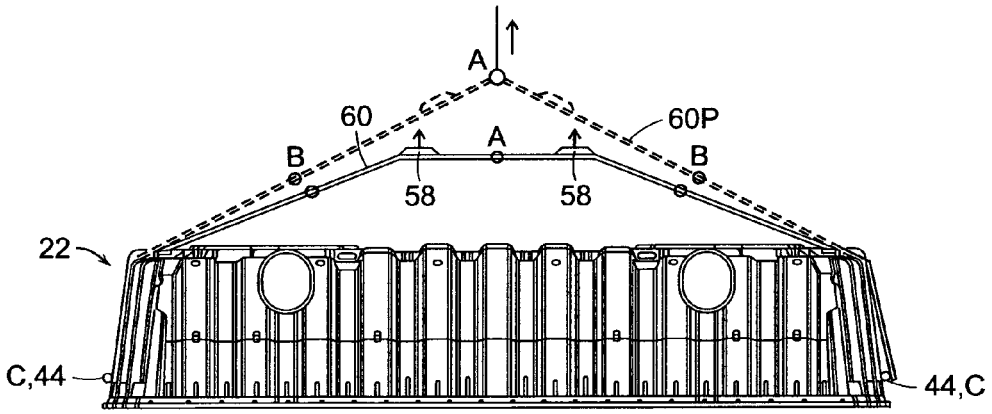
FIG. 9 is a side view of a half tank, having an attached sling of FIG. 8.

When mechanical devices such as fork-lift trucks are available, other features and methods may be used for handling tanks. FIG. 8 shows a lifting device, sling 60, which is useful for lifting one or more half tanks. Sling 60 is shown in combination with a half tank 22, shown in phantom. The forks 56 of a forklift vehicle which engage the sling 60 are also shown in phantom. The free ends of the sling legs B-C attach to grips 44, as described above, or to alternative attachment features provided at the ends of the tank. Connector B-B runs lengthwise, in the vertical center plane of the half tank, interconnecting the all four sling legs B-C. Two loops 58 in the connector B-B are shaped to receive the tine ends of the forks 56 of a forklift truck, and thus the forks may be used to lift the half tank, as shown in the side elevation view of FIG. 9. Alternately, lifting may be accomplished by attaching a lifting machine to center point A of connector B-B, which results in the sling assuming the shape of sling 60P, shown in phantom in FIG. 9.

Sling parts may be made of woven nylon or other plastic strap, familiarly used in industrial lifting slings. In the generality of this aspect of the invention, the portion B-B of lifting device 60 may be rigid, in which case it might ordinarily be referred to as a spreader or beam; alternately, the whole of the sling may comprise rigid or semi-rigid elements.

In synopsis, use of the grips for manual or machine lifting avoids the possibility of damage to the mating surface of the flange if it was grasped; and, use of a sling 60 facilitates raising a single half tank from the top of a concave-down stack when the stack is too high for workers to manually remove the half tank, and it permits simultaneous lifting of a multiplicity of nested half tanks when the free ends C of the sling are connected to the hand grips of a half tank which underlies a multiplicity of other nested half tanks.

Figure 10:
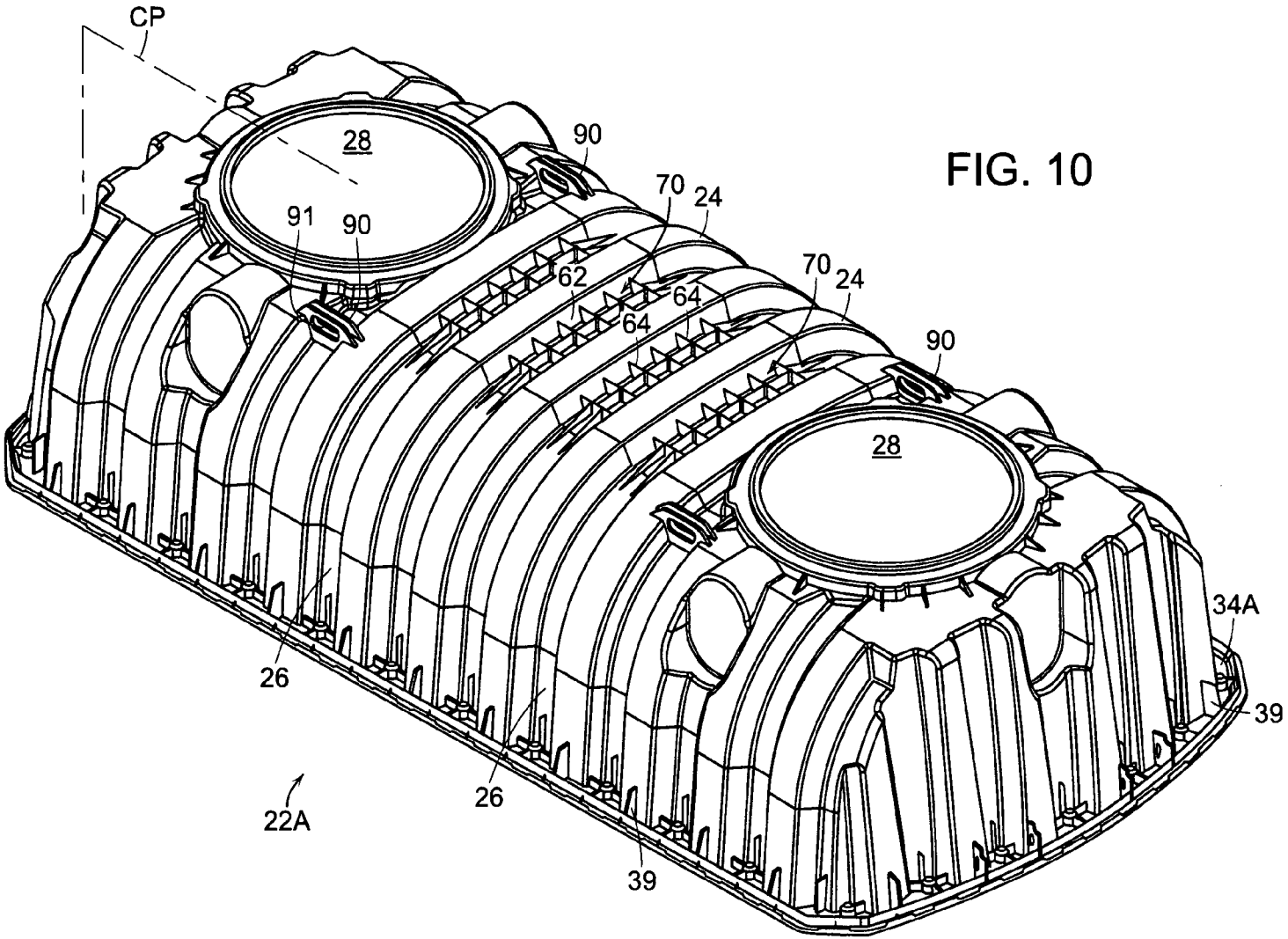
FIG. 10 is a quasi-isometric view of a half tank showing the ribbing which runs in the valley corrugations where they run to the apex of the half tank.
Figure 13:
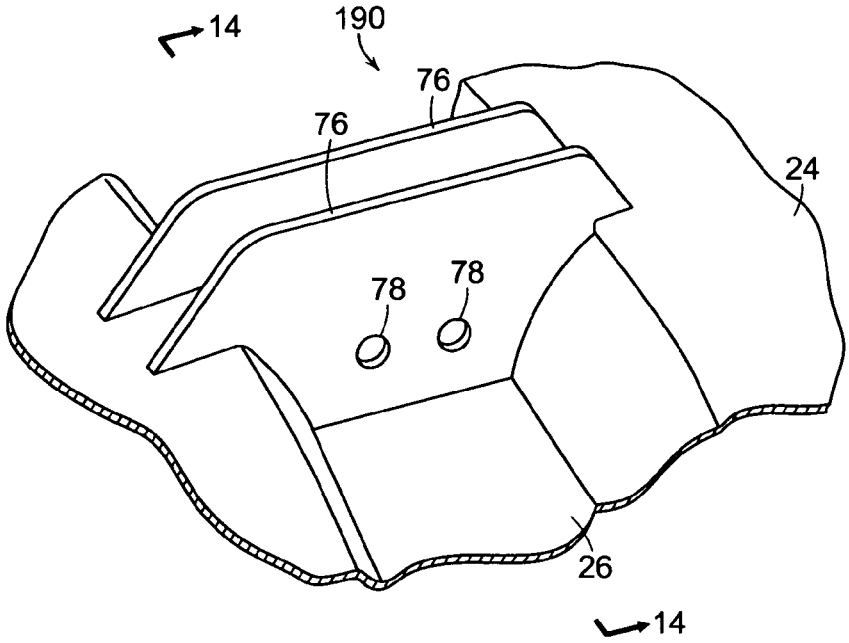
FIG. 13 is a perspective view of a small portion of the top of a half tank, showing a valley corrugation within which runs a lifting tab or lug, a hole for a rope.
Figure 14:
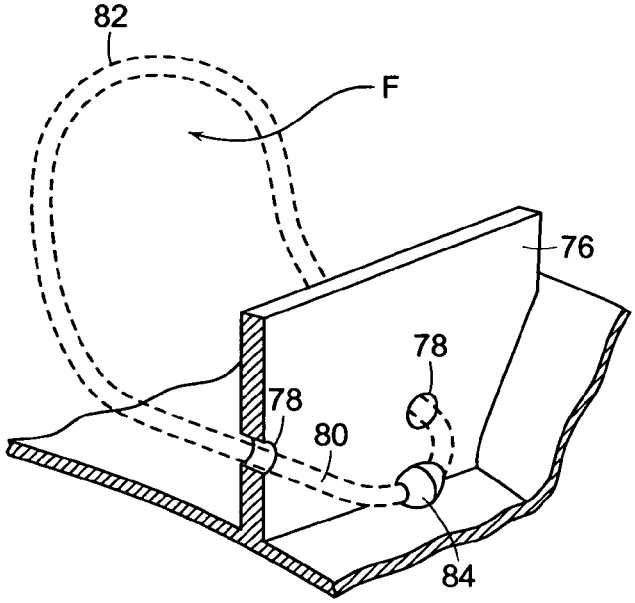
FIG. 14 is a cutaway view of the tabs of FIG. 14 showing how a rope loop that can be engaged with the fork of a lift truck runs through the holes.

FIG. 10 also shows that a half tank, and thus an assembled whole tank, may have a second integral means for lifting, namely have four molded in features, commonly referred to as lifting lugs 90, at the top of the tank. Preferably each lug 90 comprises a pair of plates, each with a through hole. FIG. 13 and FIG. 14 show another lifting lug embodiment in which a typical tab sets 190 comprise a pair of plates 76 (FIG. 13) running transverse to a valley 26 and lengthwise along the tank, or a single plate (FIG. 14). Preferably, each plate 76 has two holes 78 sufficient in diameter for passage of a rope 80 (shown in phantom) which may be knotted at point 84 so it forms a loop. The upper end 82 of the rope loop can be raised up as shown, so it can be grasped by a lifting device, such as a sling or crane components, as indicated by the arrow F.

In an embodiment of the present invention wherein a septic tank has two spaced part circular regions suited for access ports, or where ports have been cut or molded in, a plurality of "egg crate" type grids 70 which are molded into the exterior top of the tank half 22A, to provide strength for resisting the loads and for helping meet the testing requirements mentioned in the Background. See FIG. 10. The grids are preferably also inside the tank as described below.

Preferably, each grid 70 comprises a center rib 62 running along the length of an exterior valley corrugation 26 (and transverse to the center plane CP of the half tank), together with a plurality of ribs 64 which are perpendicular to the rib 62 (and parallel to center plane CP). The ribs 64 connect opposing sides of the valleys, which are of course also the sides of the peak corrugations which space apart the valleys. Those side portions of the corrugation valleys and peaks are often referred to as webs in some prior art; and peaks are often referred to as crowns. A grid 70 is present in each of the exterior valleys which generally lie between the portal regions 28 in the embodiment of FIG. 10. The grid pattern is only present within valleys in vicinity of the apex, or upper portion of a half tank viewed in concave-down orientation.

Grids 70 in the valleys add to the strength which the alternating peak and valley corrugations provide to the top of the tank. The half tank top thus has substantial strength against soil and other overlying loads in an efficient way. Grids 70 may have other configurations than those shown in FIG. 10. For instance, there may be a plurality of diagonal ribs to form a plurality of X patterns.

In one embodiment, the surfaces of the ribs of the valley grids have an elevation, relative to the floor of the valley in which they run, which is less than the elevation of the high points of the peak corrugations on either side of a valley. That leaves a slight depression between adjacent peak corrugations, and provides a groove-like bearing surface for tethers of deadman anchors (or tethers used in transport of tanks) which run across the top of the tank, to hold down the tank, as described next. In another embodiment, the surfaces of the ribs of the valley grids are at about the same elevation as the adjacent peak corrugations, or higher than such, thus providing greater strength to the half tank.

Grids of the same or different pattern as grids 70 on the exterior valleys are preferably also present in the interior valleys, i.e., those within the concavity of the half tank. Those valleys of course are the interiors of the peak corrugations, as they are perceived on the exterior of the tank. Interior valley grids 71 can be seen in half tank 22B of FIG. 1, which half tank is identical to top half tank 22A. The grids 71 are preferably present within the interior valleys only in those portions of valleys which lie generally between the access port regions and which correspond with the aforementioned exterior valley-grid locations.

Figure 11:
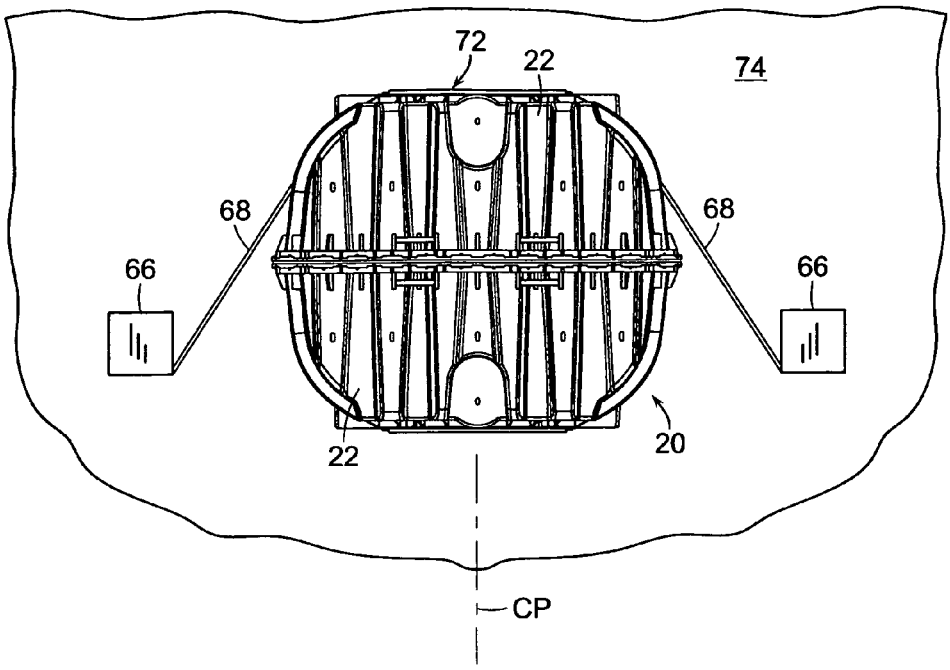
FIG. 11 is an end view of a FIG. 1 tank buried in soil along with adjacent deadmen and an interconnecting hold-down strap.

As mentioned in the Background, deadmen which are typically heavy concrete bars may be used to anchor a tank, to resist any buoyant forces. FIG. 11 shows a tank 20 formed of mated half tanks 22 buried in soil 74 along with opposing side deadmen 66. Tethers 68 which may comprise, ropes, cables or other kinds of flexible or rigid tensile members run from one deadman 66, across the top 72 of the tank which of course is the apex of the convex exterior of the half tank 22, to an opposing side deadman 66. Typically there are at least two tethers, one near each access port. Tethers 68 may run in the along the grid-containing valleys mentioned above. Or tethers may run along the tops of the peak corrugations; and the grids and other ribs can be shaped to provide an essential channel running across the top of the concave-down half tank. Thus, when there is buoyant force on the tank, a tether presses downwardly on the surface of a grid 70, and, any hold-down force exerted by the tethers 68 is well-resisted by the top of the tank. In use of this aspect of the invention there will be at least one tether and there may be more than two deadmen.

Tanks of the present invention are subjected to still other loads which might not be expectable. For example, sometimes a tank is assembled and placed on a flat hard surface, such as the concrete floor of a work shop; and it is then tested by partially or wholly filling the tank with water. In such condition, the loading on the bottom of the tank is found to be significantly different from that which results in normal use, when the tank is buried within in more fully supportive soil. Even though the circular region 28 intended for an access port has ribbing in the interior, as can be seen in FIG. 1, the water-test loading can cause failure in vicinity of the circular region.

Figure 15:
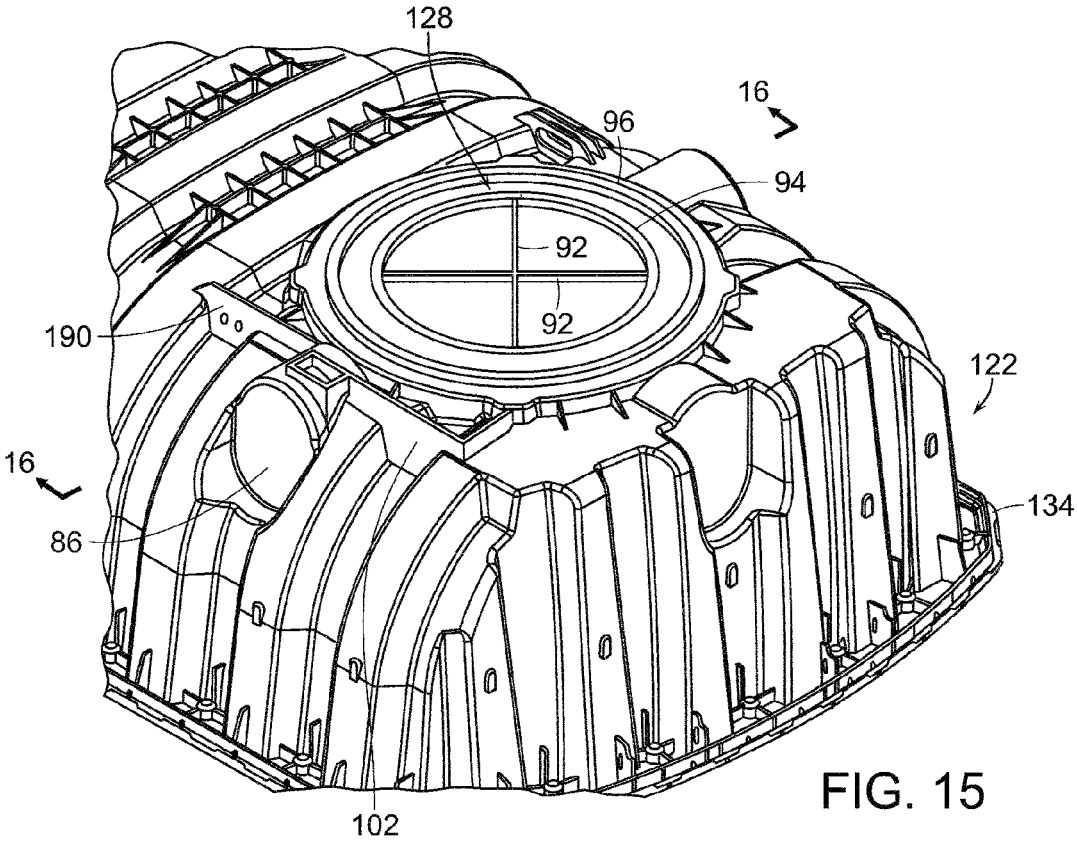
FIG. 15 is a quasi-isometric view of the end of a half tank, like FIG. 5, showing ribbing on the access port exterior and amongst adjacent corrugations.
Figure 16:
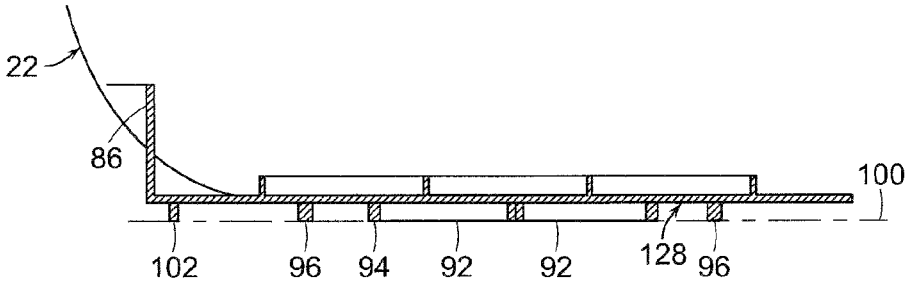
FIG. 16 is a transverse cross section of the half tank of FIG. 15, where the half tank is turned upside down and shown as it would rest on a planar supporting surface when acting as the bottom of a tank.

FIG. 15 and the associated partial lengthwise vertical plane cross section of FIG. 16 illustrate other tank features which provide strength. FIG. 16 shows in transverse cross section the half tank 122 of FIG. 15, as it is when turned upside down to act as the bottom of a whole tank. Half tank 122 is shown resting concave-up on a planar supporting surface 100, shown in phantom, as it would when it is acting as the bottom portion of a tank.

There is a circular fence 96 which forms the nominal edge of an access port hole when one is cut in the region 128, as well as the locator or attachment point for a riser or lid. The outer edge of the fence 96 lies substantially in a plane. Typically fence 96 is continuous as shown, but it may be intermittent and all outer portions may not lie in the same plane. In half tank embodiment 122, the exterior surface of the access port plate-like region 128 has ribbing 92, 94 that lies within the circular fence 96. As shown in FIG. 16, ring 94 and X-ribbing 92 have elevations such that the outer edges thereof line in substantially the same plane as the outer edge of the molded-in locating and attachment fence 96. Thus the ribbing 92, 96 transfers the load of interior water applied to region 128 to the support surface 100 and prevents the center of the region 128 from deflecting downwardly toward surface 100 to the possible point of fracturing.

For similar support reasons exemplary half tank 122 has further outer ribbing which is on the upper convex exterior surface, adjacent either side of the access port region 28, 128. As shown in FIG. 15, exemplary further ribbing 102 has an elevation such that the outer edges lie in substantially the same plane as the other ribbing 92, 94 and fence 96, to similarly provide support and to limit deflection and strains.

The side ribbing 102 which runs across the top of buttress 86 is of course present on both sides of both access port feature locations; only one array of exemplary side ribbing 102 is shown in FIG. 15. Other configurations of ribbing may be utilized than the illustrative examples; generally, ribbing is placed on the convex exterior apex of the half tank with elevation sufficient height to mate with a planar surface which touches the highest portion of the convex exterior of the half tank.

The half tanks of the invention may be made of a thermoplastic such as polypropylene or high density polyethylene. In the generality of the invention, the half tanks may be made by means other than injection molding, and they may be made of a non-thermoplastic resin. In an exemplary septic tank having two access port locations, the typical wall thickness of the tank will be about 0.22 inch and the typical thickness of valley ribs 62, 64 may vary from about ¼ to ⅜ inches. The corrugations will have a nominal depth/height of about two and a half inches; and, valley corrugations may be spaced apart about 11 inches center to center, in the region between the opposing end access ports. A half tank which is part of a nominal 1000 gallon septic tank may weigh around 150 pounds.

In the embodiments pictured here, the half tanks are preferably identical and thus a top and bottom can made by using the same mold, reducing tooling costs. However, in the generality of the invention, the top half may be of a configuration different from that of the bottom half, and the plane of the mating flanges may not be mid-way between the top and bottom of the tank. Such tanks parts shall be considered equivalent to true half tanks. For example, the two halves may have substantially the same shape, but the half used as the bottom may lack the port regions and grid within the valleys. In another embodiment, the two halves do not have substantially the same shape, although of course the flanges have to mate. Further, while an invention tank is preferably corrugated, in the generality of the invention the tank may be un-corrugated. While the invention is described in terms of a tank which is oblong, the invention may be used with tanks which have round or otherwise symmetrical flanges.

Although this invention has been shown and described with respect to one or more embodiments, it will be understood by those skilled in this art that various changes in form and detail thereof may be made without departing from the spirit and scope of the claimed invention. Any use of words such as "preferred" and variations suggest a feature or combination which is desirable but which is not necessarily mandatory and embodiments lacking such preferred feature may be within the scope of the claims.

What is claimed is:

1. An injection molded plastic half tank shaped for mating with a like half tank to form a whole tank for containing liquid, the half tank having a lengthwise vertical center plane, comprising:

a wall having a generally convex exterior and a generally concave interior and a circumscribing edge;

a substantially planar flange running along said edge of the wall in a plane which is perpendicular to said vertical center plane, for mating with the flange of a like half tank;

a plurality of integral tabs extending from the exterior of the half tank wall at each end of the tank and running parallel to said vertical center plane, located at each lengthwise end of the half tank proximate said flange, each tab having a through hole for receiving a grip; and, one or more rigid or flexible grips removably engaged with the through hole of each tab, for lifting of the half tank.

2. The half tank of claim 1 wherein the plurality of tabs comprises: at least one pair of integral tabs at each opposing end of a half tank; and, at least one removable flexible or rigid grip running between the two tabs of each of said at least one tab pair, each grip running across said vertical center plane in a direction which is generally parallel to the plane of said flange.

3. The half tank of claim 1 wherein the plurality of tabs comprises: two pairs of integral tabs at each lengthwise end of the half tank, the two pairs spaced apart so that one tab pair is on either side of said vertical center plane; and, wherein said rigid or flexible grip runs between the tabs of each tab pair, the grip having a length between the tabs of each tab pair which is sufficient for manual grasping of the grip and thereby lifting of the end of the half tank.

4. The half tank of claim 1 wherein said integral tab pairs are stacking lugs having a dimension sufficient to keep the flanges of like-half tanks spaced apart a distance which enables manual access to the each of said rigid or flexible grips when a multiplicity of half tanks are nested with each other.

5. The half tank of claim 1 further comprising a sling, connected to two or more of the grips, having a sling portion which extends lengthwise on the convex exterior of the half tank, the lengthwise portion having two spaced apart loops, each loop spaced apart from the grips, the loops shaped for receiving the tines of a forklifting device.

6. A septic tank comprised of two half tanks of claim 1, wherein the substantially planar flange of each half tank is mated and attached to the substantially planar flange of the other half tank.

7. A method of transporting, assembling, and installing a tank in an excavation in soil, wherein the tank is formed from two half tanks, each half tank having a vertical center plane, a length, and opposing ends and comprising (i) a wall having a concave interior surface and a convex exterior surface;

(ii) a planar surface flange running around the periphery of the wall;

(iii) two spaced apart integral circular portions on the convex exterior surface of the wall, shaped for enabling access ports to be cut therein; and, (iv) first lifting means comprising at least two tabs spaced apart across said vertical center plane at each of the opposing ends of the half tank proximate said flange, each tab having a through hole for receiving a grip, the tabs running perpendicular to the planar surface flange, together with at least one grip at each end of the half tank, each grip detachably engaged with the through hole of said two tabs, and each grip shaped for manual grasping of the half tank; which method comprises:

(a) stacking half tanks with concave interior surfaces facing downwardly and with the flanges spaced apart so that said first lifting means is manually accessible between the spaced apart flanges;

(b) transporting the stacked half tanks to an assembly site;

(c) lifting a first half tank from the stack manually by grasping each end of the half tank at the grip portions of said first lifting means;

(d) rotating the first half tank in space while manually grasping each end of the tank by said first lifting means, and placing the half tank on a work surface so the concave interior surface of the wall faces upwardly;

(e) lifting a second half tank from the stack by manually grasping each end of the half tank at the grip portions of said first lifting means;

(f) placing the second half tank on top of the first half tank so the concave interior surface thereof faces downwardly and then mating the flanges of the half tanks; and (g) fastening the two half tanks to each other to form a whole tank; and then (h) lifting the whole tank by means of a mechanical lifting device engaged with loops along the length of a sling running lengthwise along the second half tank and connected to said tabs, to thereby move the whole tank to a different location or to install the whole tank in an excavation in soil.

8. An injection molded plastic half tank shaped for mating with a like half tank to form a whole tank for containing liquid, the half tank having opposing ends and a lengthwise vertical center plane, comprising:

a wall having a convex exterior and a concave interior and a circumscribing edge;

a substantially planar flange running along said edge of the wall in a plane which is perpendicular to said vertical center plane, for mating with the flange of a like half tank;

two pairs of integral tabs at each lengthwise end of the half tank, the tabs extending from the exterior of the half tank wall in proximity to said flange and running in a direction parallel to said vertical center plane, the pairs at each end spaced apart so that one tab pair is on either side of said vertical center plane, wherein each tab of each pair has a through hole for removably receiving a grip; and, a rigid or flexible grip running between the tabs of each tab pair, the grip removably engaged with the through hole of each tab, the grip having a length between the tabs which is sufficient for manual grasping and lifting of the end of the half tank.

9. The injection molded plastic half tank of claim 8 where the grip-receiving feature is a hole in the tab, and wherein the grip is a flexible member.

10. A septic tank comprised of two half tanks of claim 8, wherein the substantially planar flange of each half tank is mated and attached to the substantially planar flange of the other half tank.

* * * * *